US005425072A

United States Patent [19]

Li et al.

[11] Patent Number: 5,425,072

[45] Date of Patent: Jun. 13, 1995

[54] METHOD OF HEAT TREATING A RADIOACTIVE SURFACE

[75] Inventors: Lin Li, Liverpool; Peter J. Modern, Flint; William M. Steen, Wirral, all of United Kingdom

[73] Assignee: British Nuclear Fuels plc, Cheshire, United Kingdom

[21] Appl. No.: 108,565

[22] PCT Filed: Dec. 30, 1992

[86] PCT No.: PCT/GB92/02404

§ 371 Date: Aug. 24, 1993

§ 102(e) Date: Aug. 24, 1993

[87] PCT Pub. No.: WO93/13531

PCT Pub. Date: Aug. 7, 1993

[30] Foreign Application Priority Data

Jan. 4, 1992 [GB] United Kingdom ..... 9200107
May 1, 1992 [GB] United Kingdom ..... 9209473

[51] Int. Cl.[6] ..... G21C 19/42

[52] U.S. Cl. ..... 376/310; 376/309; 376/326; 588/10

[58] Field of Search ..... 376/309, 310, 326; 976/DIG. 391, DIG. 392, DIG. 393; 252/626, 628; 588/10

[56] References Cited

U.S. PATENT DOCUMENTS

| | | | |
|---|---|---|---|
| 4,565,670 | 1/1986 | Miyazaki et al. | 252/626 |
| 4,591,454 | 5/1986 | Ohtsuka et al. | 252/626 |
| 4,676,586 | 6/1987 | Jones et al. | 350/96.2 |
| 4,920,994 | 5/1990 | Nachbar | 376/310 |
| 5,256,848 | 10/1993 | Cartry et al. | 376/310 |
| 5,283,010 | 2/1994 | Waring | 252/626 |

FOREIGN PATENT DOCUMENTS 0091646 10/1983 European Pat. Off. .

*Primary Examiner*—Donald P. Walsh
*Assistant Examiner*—Fred Voss
*Attorney, Agent, or Firm*—Nixon & Vanderhye

[57] ABSTRACT

In a method of treating a surface 12 of an object 10 contaminated with radionuclides 14, a laser source 16 is directed at the surface 12 to apply a local area 18 of intense heat to the surface 12. The laser source 16 is arranged to pass in a raster manner to cause local melting of the surface 12, surface 12 subsequently solidifying and fixing the radionuclides 14 therein. At least one layer of a coating material be applied before or after the application of the intense heat to fix and seal the radionuclides on or in the object.

13 Claims, 1 Drawing Sheet

METHOD OF HEAT TREATING A RADIOACTIVE SURFACE

BACKGROUND OF THE INVENTION

1. Field of the Invention

This invention relates to a method of treating a surface, and more particularly a surface contaminated with radionuclides.

2. Discussion of the Prior Art

In the nuclear industry, surfaces of objects including mechanical components and constructional features may become contaminated with radionuclides such as cobalt-60, caesium-137 or strontium-90, or radioactive compounds such as $PuO_2$ or $UO_2$. Current practices for treating these surfaces include the use of chemical reagents, and abrasive jets. However, the contaminating radionuclides may penetrate deeply into the surface portion of the components or features and may present difficulties in being removed by these known surface treatments.

A number of alternative surface treatments have been tried by others. One such treatment is described in European patent specification number EP 91646 A1 which discloses a method of removing a radioactive metal oxide from the surface of a radioactive component by means of a laser beam directed at the surface. In UK patent specification number GB 2242060 A a concrete surface contaminated with tritium is treated by irradiating the surface with microwaves in order to vaporise water from the surface thereby removing tritium. German patent specification number DE 3500750 A discloses a method for removing radioactively contaminated surface layers of concrete from a reinforced concrete structure by inductively heating the reinforcing bars within the structure. In a further method, described in Japanese patent specification number JP 3002595 A, a radioactively contaminated concrete surface is removed by irradiating the surface with microwave radiation.

In all of these alternative treatments radioactive contamination is removed from a surface or else the contaminated surface is itself removed. Because of the nature of these treatments, the contamination becomes airborne thus necessitating downstream processing and leading to further complications and expense.

SUMMARY OF THE INVENTION

According to the present invention there is provided a method of treating a surface contaminated with radionuclides, the method comprising passing a local area of intense heat across the surface so as to fix or seal the radionuclides therein.

As stated previously, the aforementioned alternative treatments are used to remove contamination from a surface or to remove a surface layer containing contamination. None of these aforementioned treatments provide a method which achieves fixing or sealing of the contamination to a surface as is provided by the present invention. The present invention allows simpler and cheaper treatment.

Desirably, in the present invention, the intense heat has an energy level of at least 150 $W/cm^2$. Preferably, the intense heat is applied by a laser source, or from a laser source through a fibre optic cable.

The local area of intense heat may be passed, eg in an x-y raster fashion across the surface by moving the object defining the surface and/or by moving a source of the intense heat. A relatively large treatment area may be achieved by overlapping movement of the object and/or the source of the intense heat.

The contaminated surface may comprise a layer applied to an object, for example a paint, or a plastics coating such as an epoxy layer.

At least one layer of a coating material may be applied before or after the application of the intense heat to fix and seal the radionuclides on or in the object by melting the coating material and forming a bond of the coating material to a substrate, or by forming a fused layer comprising the coating material and said substrate material. Examples of coating materials include glass, metal, ceramics, pozzolana and chamotte, or a mixture thereof. A further application of intense heat may be necessary to bond the coating to the surface.

In another application of the invention to a metal surface, the local area of intense heat causes local melting of the metal at the surface which subsequently solidifies as the local area of intense heat passes across the surface. The melting and re-solidification at the surface fixes the radionuclides in the metal and may repair local faults at the surface such as porosity or cracks.

BRIEF DESCRIPTION OF THE DRAWINGS

The invention will now be further described by way of example only with reference to the accompanying drawings in which.

DETAILED DISCUSSION OF PREFERRED EMBODIMENTS

Figure 1:
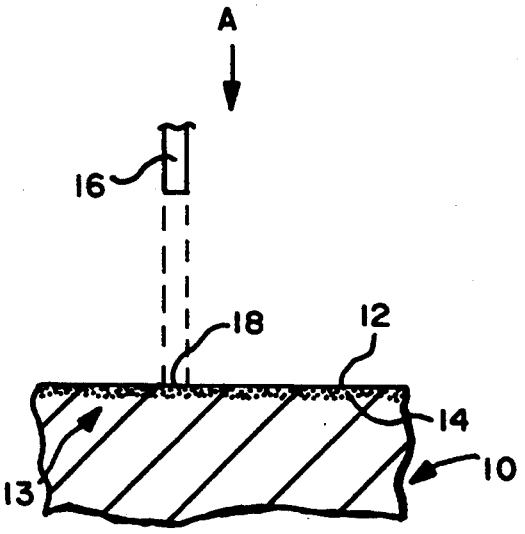
FIG. 1 shows a side sectional representation of the invention applied to a metal object.
Figure 2:
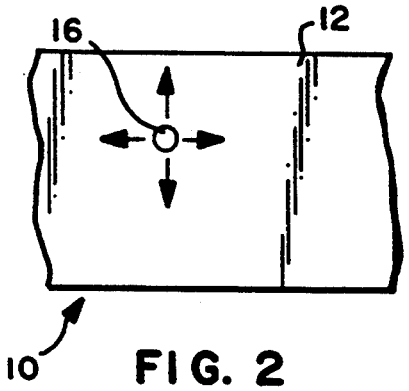
FIG. 2 shows a view in the direction of arrow A of FIG. 1.

Referring to FIG. 1, a portion of a steel object 10 is shown having a surface 12 with an internal layer 13 in which radionuclides 14 are embedded. A laser source 16 is shown directed at the surface 12 to apply a local area 18 of intense heat to the surface 12. The laser source 16 as shown in FIG. 2 is arranged to pass in a raster manner, as shown by the arrows, across the surface 12 to pass the local area 18 of intense heat across the surface 12.

In operation, the local area 18 of intense heat applied by the laser source 16 is arranged to cause local melting at the surface 12 without vaporization thereof, the molten surface 12 subsequently solidifying and fixing the radionuclides 14 therein as the laser source 16 passes across the surface 12.

Figure 3:
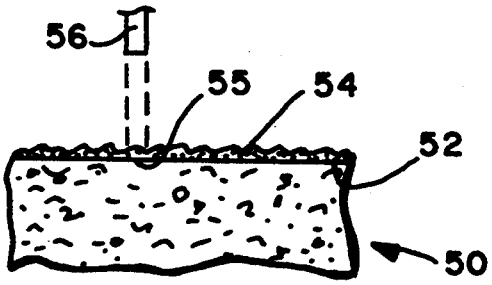
FIG. 3 shows a side sectional representation of an embodiment of the invention applied to a concrete object.

In an alternative application of the invention shown in FIG. 3 to a concrete object 50 having a surface 52 contaminated with radionuclides (not shown), a layer 54 of a sealant is applied to the surface 52 and is melted by a local area 55 of intense heat applied by a laser source 56 so as to fix the radionuclides to the surface 52. Suitable sealants include: an inorganic paste such as water glass, metal powder, ceramic powder, glass powder, pozzolana and chamotte, or a mixture thereof, and may be applied by conventional techniques such as spraying. The application of pozzolana and chamotte to a concrete surface causes a reaction with free lime at elevated temperatures. This generates a ceramic bond of the coating to the concrete surface, and leaves a glassy substantially poreless coating after application of the intense heat. More than one such layer 54 may be applied.

The invention may be performed by alternative heat sources such as: flame, plasma ion, ultrasonic energy, microwaves, and induction heating, for example to melt the layer 54. Suitable laser sources include: a $CO_2$ laser, a Nd-YAG laser, an excimer laser , or a semi-conductor laser. A neodymium-yttrium aluminium garnet (Nd-YAG) laser source is preferred since the radiation therefrom may be transmitted through a fibre optic cable. Such a cable is readily movable to facilitate movement of the transmitted local area of intense heat from the laser source across the surface.

If desired the use of an appropriate sealant layer 54 nay be applied to non-concrete surfaces, eg steel.

For most applications of the invention, a local area of intense heat of at least 150 $W/cm^2$ is preferred.

It will be understood that instead of or as well as moving the laser source or the fibre optic cable in the afore-described applications of the invention, the object having the contaminated surface may be moved to pass the local area of intense heat across the surface.

Figure 4:
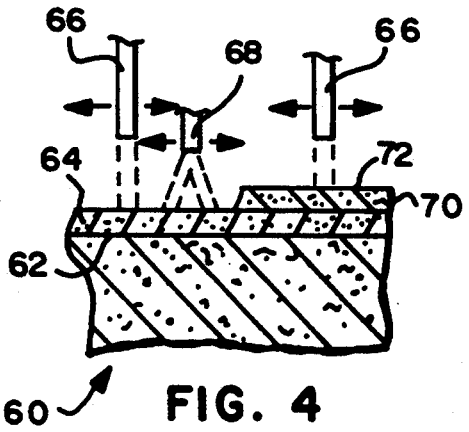
FIG. 4 shows a side sectional representation of an alternative application of the invention to a concrete object.

Referring to FIG. 4, a portion of concrete object 60 is shown having a surface 62 contaminated with radionuclides (not shown). A first layer 64 of cementitious material is applied to the surface 62, and is set on the surface 62 with the assistance of heat from a laser source 66 arranged to be traversed across the first layer 64, it is soaked with water for about one minute from a water source 68 to reverse the dehydration of lime in the first layer 64, and allowed to reset for more than twenty four hours. A second layer 70 of cementitious material similar to the first layer 64 is applied to the first layer 64, and heat from the laser source 66 is then traversed across the second layer 70 in 'x-y' raster manner to set the second layer 70 and produce a vitreous surface 72.

The cementitious material for the first layer 64 preferably comprises a mixture in optimum proportions of:

Chamotte—70%
Pozzolana—10%
industrial water glass—20% and the second layer 70 preferably comprises a mixture in optimum proportions of:

Pozzolana—40%
Pozzolan—35%
Chamotte—20%
industrial water glass—5%
water

Such a cementitious material should provide sufficient silicate content for the formation of glass in the second layer 70 after heating by the laser source 66, although if desired the first layer 64 and the second layer 70 may have compositions that differ from each other.

It is an advantage if the direction of traverse of the laser source 66 on the second layer 70 is perpendicular to the direction of traverse of the laser source 66 on the first layer 64, since this should lead to a smoother surface with improved impact resistance of the second layer 70.

Some advantage might be gained in impact resistance of the second layer 70 by adding small amounts of granite powder, or metal powders such as stainless steel to the cementitious mixture. Small amounts of zinc powder in the mixture should also improve the smoothness of the layers 64, 70.

For some applications, a thickness of each layer 64, 70 of between 0.5 mm and 0.8 mm should be satisfactory.

Suitable lasers include a 2 kW Electrox $CO_2$ laser, and a 400 W Lumonics Nd-YAG laser. The Nd-YAG laser can be transmitted through optical fibres. A laser beam of spot size between 4 to 8 mm diameter may be used. If desired the surface to be heated by the laser source 66 may be protected by an inert shroud gas such as nitrogen or Argon.

Figure 5:
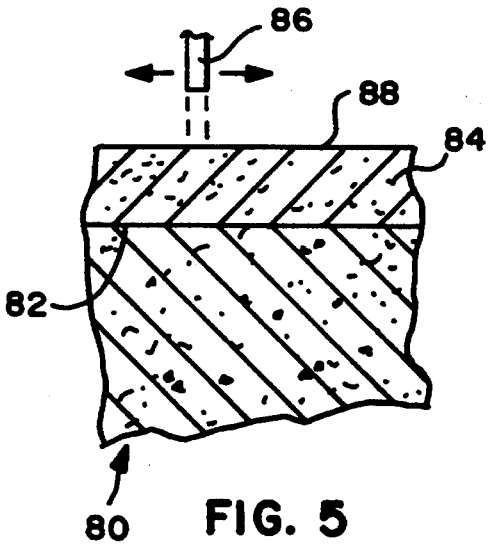
FIG. 5 shows a side sectional representation of a further alternative application of the invention.

Referring now to FIG. 5, a portion of a concrete object 80 is shown having a surface 82 contaminated with radionuclides (not shown). A thick layer 84 (eg $<5$ mm) of cementitious material is applied to the surface 82, and heat from a laser source 86 then applied to the layer 84 to form a vitreous coating ( 1 mm) at the surface 88 of the layer 84. The layer 84 preferably comprises a mixture of:

Chamotte
sand/granite
Pozzolana (small amounts)
industrial water glass
water

Use of a relatively high percentage of Pozzolana/Pozzolan at the top of the layer 84 assists in the formation of the vitreous coating at the surface 88.

A laser source 86 similar to the laser source 66 may be used. The thickness of the layer 84 inhibits heat from the laser source 86 reaching the surface 82 at a temperature high enough (500° C.) to cause substantial dehydration of free lime in the layer 84 at the surface 82.

Before the layer 84 is applied to the surface 82, an initial heat treatment may be applied to the surface 82 by the laser source 86.

We claim:

1. A non-contact method of treating a surface of an object contaminated with radionuclides, the method comprising the steps of:

applying at least one layer of a coating material to said surface; and passing a local area of intense heat across the coating material thereby providing a vitreous coating over the surface and fixing or sealing the radionuclides therein.

2. A method as claimed in claim 1, wherein the local area of intense heat has an energy level of at least 150 $W/cm^2$.

3. A method as claimed in claim 2, wherein the intense heat is provided from a source comprising a laser means.

4. A method as claimed in claim 3, wherein the laser means includes a fibre optic cable through which the intense heat from the laser is applied.

5. A method as claimed in claim 3, wherein the laser means comprises a neodymium-yttrium aluminium garnet laser.

6. A method as claimed in claim 1, wherein the intense heat is passed across the surface by moving the object relative to the source of the intense heat.

7. A method as claimed in claim 6, wherein the source of the intense heat and the object are moved in overlapping manner.

8. A method as claimed in claim 1, wherein the surface comprises a metal, and the intense heat is such as to melt the surface.

9. A method as claimed in claim 1 and wherein a further layer of a coating material is applied to the surface after the application of the intense heat.

10. A method as claimed in claim 1, wherein the contaminated surface is a cementitious surface.

11. A method as claimed in claim 1, wherein the contaminated surface is a metallic surface.

12. A method as claimed in claim 1, wherein the coating comprises at least one of a refractory material, a cementitious material, a metal powder, a ceramic, and a mixture thereof.

13. A method as claimed in claim 3, wherein the laser means comprises one of a Nd-YAG laser, a $CO_2$ laser, an eximer laser and a semiconductor laser.

* * * * *